US005657703A

United States Patent [19]

Johnson

[11] Patent Number: 5,657,703

[45] Date of Patent: Aug. 19, 1997

[54] PORTABLE WORK STATION

[76] Inventor: Bryan T. Johnson, 4310 Hillview La., Vadnais Heights, Minn. 55127

[21] Appl. No.: 542,312

[22] Filed: Oct. 12, 1995

[51] Int. Cl.[6] ..... A47B 3/02

[52] U.S. Cl. ..... 108/118; 108/69

[58] Field of Search ..... 108/115, 118, 108/65, 166, 167, 72, 69

[56] References Cited

U.S. PATENT DOCUMENTS

| | | | |
|---|---|---|---|
| 559,743 | 5/1896 | Ormsby | 108/118 X |
| 2,081,212 | 5/1937 | Albano | 108/69 X |
| 2,206,004 | 6/1940 | Ford | 108/69 |
| 2,683,639 | 7/1954 | Brenny . | |
| 2,716,582 | 8/1955 | Rosenfeld . | |
| 2,743,145 | 4/1956 | Edwards | 108/69 |
| 3,188,158 | 6/1965 | Sanchez . | |
| 3,792,668 | 2/1974 | Ward | 108/69 |
| 4,036,150 | 7/1977 | Algier | 108/65 X |
| 4,117,781 | 10/1978 | Middleton et al. . | |
| 4,262,606 | 4/1981 | Hodson | 108/118 X |
| 4,561,619 | 12/1985 | Robillard et al. . | |
| 4,686,910 | 8/1987 | Skjerseth | 108/118 X |
| 4,974,525 | 12/1990 | Sheffield | 108/118 |
| 5,335,604 | 8/1994 | Jiang | 108/118 X |

*Primary Examiner*—José V. Chen

*Attorney, Agent, or Firm*—Nawrocki, Rooney & Sivertson, P.A.

[57] ABSTRACT

Portable work station having a removable panel member located along a front edge thereof. A collapsible mechanism is included for supporting the panel member. The support mechanism is hingedly secured to the panel member.

20 Claims, 5 Drawing Sheets

PORTABLE WORK STATION

FIELD OF THE INVENTION

The present invention relates to portable work stations. In particular, the present invention relates to a portable work station which is collapsible upon itself, and which may include a removable insert on the working surface.

BACKGROUND OF THE INVENTION

Portable work stations or utility tables are useful for providing a working surface, while including a foldable support structure for movement and storage. Such known work stations are disclosed in U.S. Pat. No. 2,683,639 (Foldable Utility Table with Laterally Extensible Leg Means); U.S. Pat. No. 2,716,582 (Portable Folding Table Having Nesting Top and Frame); U.S. Pat. Nos. 3,188,158; 4,117,781 (Utility Desk); and 4,561,619 (Moveable CRT Pedestal). Known work stations or foldable utility tables lack the ability to maximize the size of the work surface while providing adequate structural support for use in industrial projects.

It is desirable to have a portable work station which includes a work surface which may be adaptable to having a cut-out design for the comfort of the user. It is desirable to have a portable work station which is light-weight and solidly supported. It is desirable to have a portable work station which maximizes the work surface area, yet may be folded into a compact unit for easy movement or storage.

SUMMARY OF THE INVENTION

The present invention is a portable work station which is collapsible upon itself, and which may include a removable insert on the working surface.

In one embodiment, the portable work station includes a work surface having a removable panel located along a front edge thereof, and a collapsible support structure. A mechanism is provided for hingedly securing the work surface to the support structure.

The support structure may further include a mechanism for storing the removable panel. The work surface may further include a frame. A first side panel member is hingedly secured to a first side edge of the frame. A second side panel member is hingedly secured to a second side edge of the frame.

The support structure may include a first support member releasably coupled to the first side panel member, and a second support member releasably coupled to the second side panel member.

The support structure may also include a first U-shaped member having a first leg and a second leg. A first support leg is rotatably coupled to the first leg. A second support leg is rotatably coupled to the second leg. The support structure may further include a cross brace coupling the first support leg to the second support leg.

The mechanism for hingedly securing the support structure to the work surface may include a double hinge mechanism. The double hinge mechanism may include a set of double hinges located along an edge of the work surface and on each side of the removable panel, each double hinge including a first hinge for rotating the work surface in a first range of motion, and a second hinge spaced inward from the first hinge for rotating the work surface through a second range of motion.

The mechanism for hingedly securing the support structure to the work surface may include a first hinge system coupled between the first support leg and the work surface, and a second hinge system coupled between the second support leg and the work surface.

The portable work station work surface may further include a storage tray. The storage tray may include a lid hingedly secured to the work surface. The portable work station storage tray lid may be part of the work surface.

The present invention further includes a method of collapsing a portable work station. The method includes the steps of providing a work surface. A hinge mechanism is provided for hingedly securing the work surface to a collapsible support structure. The hinge mechanism includes a set of double hinges, each double hinge including a first hinge spaced apart from a second hinge. The work surface is rotated through a first range of motion about the first hinge. The support structure is collapsed. The work surface is rotated through a second range of motion about the second hinge.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof, and wherein:.

DETAILED DESCRIPTION OF THE PREFERRED EMBODIMENTS

Figure 1:
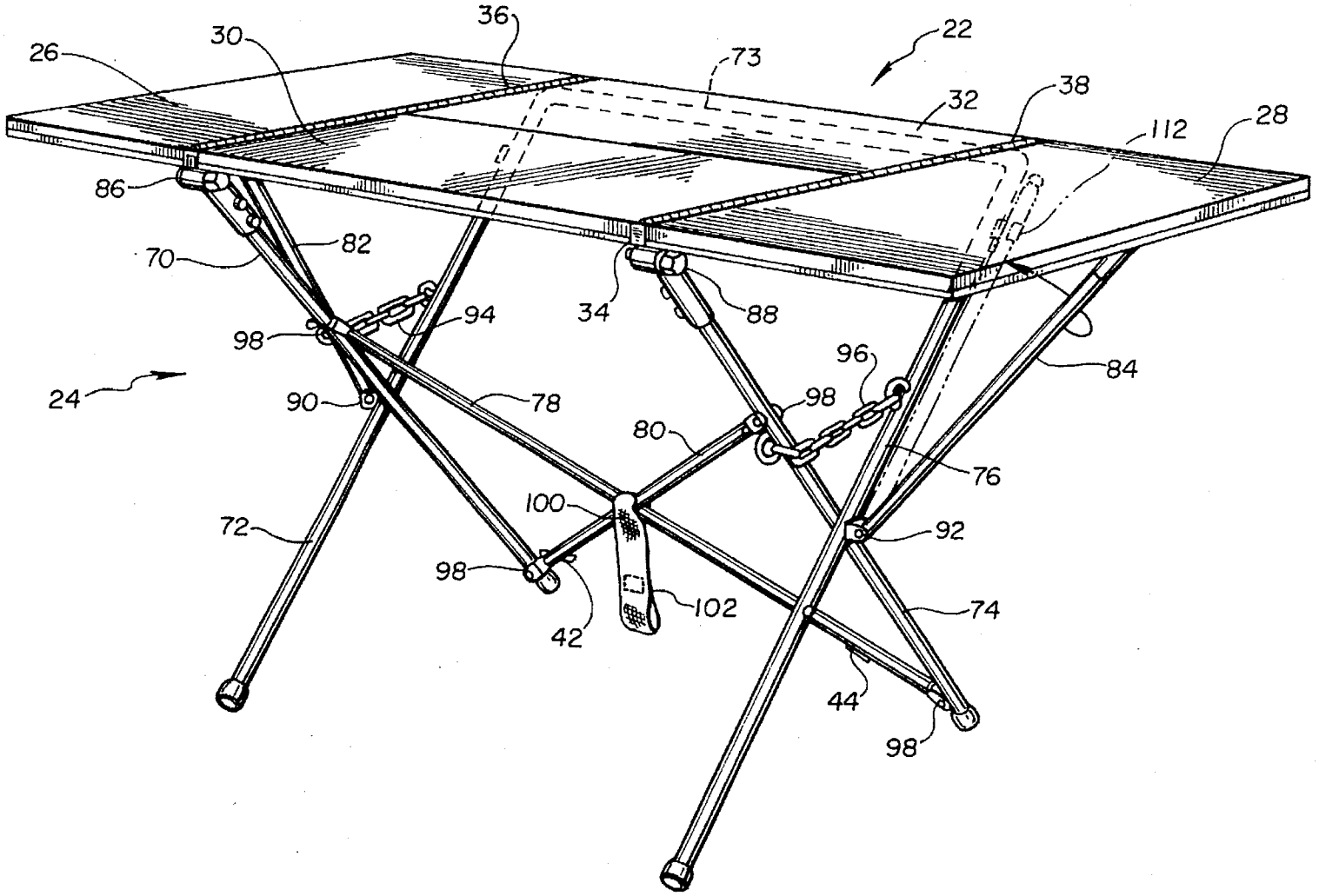
FIG. 1 is a perspective view of the portable work station in accordance with the present invention.

FIG. 1 shows the portable work station in accordance with the present invention generally at 20. The portable work station 20 includes work surface 22, which is mechanically coupled to support structure 24. Work surface 22 is generally table shaped and provides a sturdy work surface for a variety of commercial, residential, automotive, and hobby uses.

Work surface 22 is generally rectangular shaped, and includes first side panel member 26, second side panel member 28, insert panel 30, frame panel 32, and work surface frame 34. Work surface 22 is generally formed of a sturdy, light-weight material, such as aluminum.

First side panel member 26 is generally rectangular shaped and includes hinge 36 which extends longitudinally along one side of the first side panel member 26. First side panel member 26 is hingedly secured to frame 34 at hinge 36. Similarly, second side panel member 28 is generally rectangular shaped and includes hinge 38 extending longitudinally along a side of the second side panel member 28. Second side panel member 28 is hingedly secured to frame 34 at hinge 38.

Figure 2:
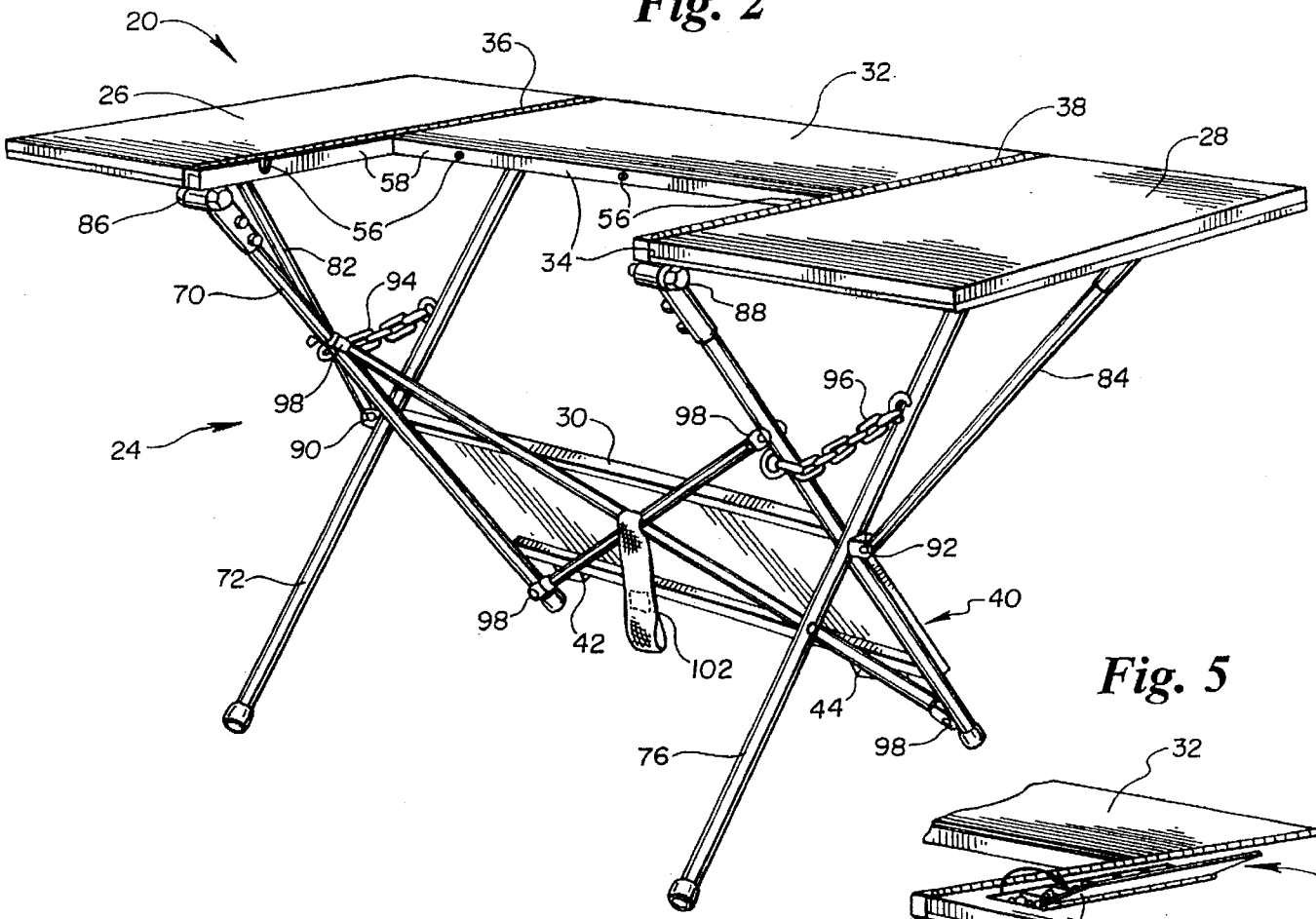
FIG. 2 is another perspective view of the portable work station in accordance with the present invention.

Frame panel 32 is fixedly secured to frame 34. Insert panel 30 is removably secured to frame 34. Referring to FIG. 2, insert panel 30 may be easily removed from work surface 22 and stored at a location 40 on support structure 24, where the insert panel 30 may be retained by holding devices 42 and 44.

Figure 3:
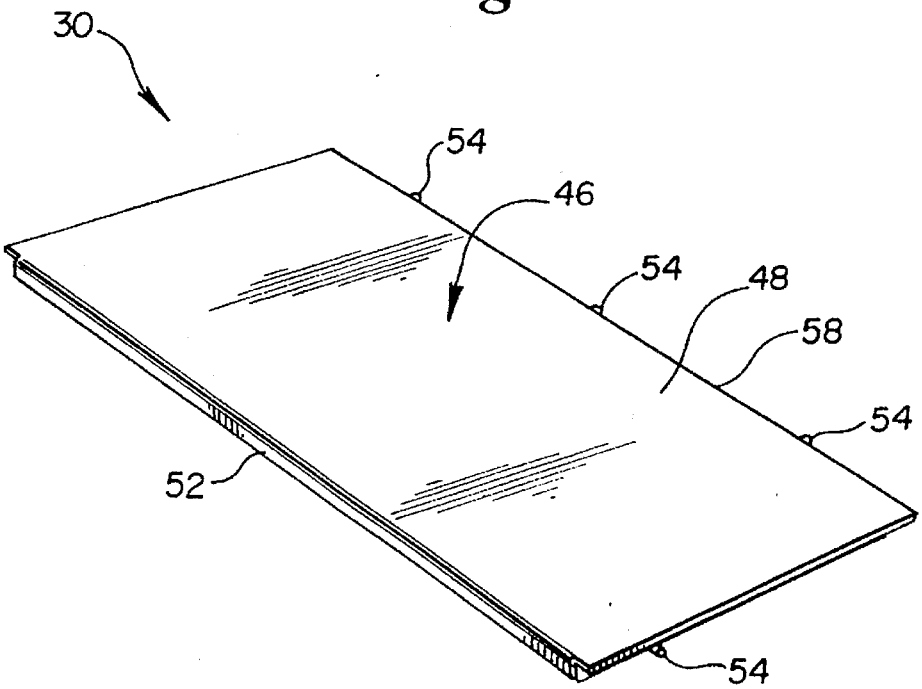
FIG. 3 is a top perspective view of the work surface insert panel for the portable work station in accordance with the present invention.
Figure 4:
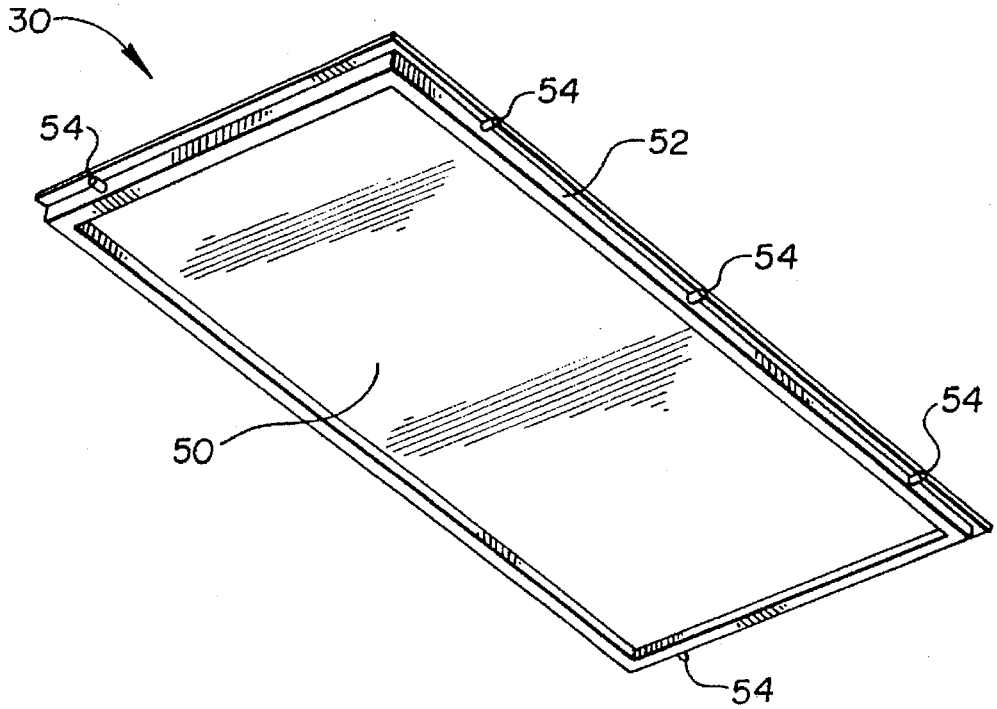
FIG. 4 is a bottom perspective view of the work surface insert panel shown in FIG. 3.

Referring to FIG. 3, a top perspective view of insert panel 30 is shown. Referring to FIG. 4, a bottom perspective view of insert panel 30 is shown. Insert panel 30 generally includes a panel member 46 having top surface 48 and a bottom surface 50. Insert frame 52 is secured to the bottom surface 50 of panel member 46 which extends beyond insert frame 52 on three sides. Support pins 54 are secured to insert frame 52 along three sides of insert frame 52.

Support pin holes 56 are located within frame 34 which correspond to the positions of support pins 54 within insert panel 30. Insert panel 30 is fixedly secured within work surface 22 by first inserting the support pins 54 located along an edge 58, within the corresponding support holes 56. Insert panel 30 is then rotated downward along a longitudinal axis defined by the edge 58, and snapped into position by inserting the remaining support pins 54 located along the sides of insert frame 52 and placed within the support pin holes 56 located along the sides of frame 34. The flanged edge of insert panel 30 extends beyond the frame 34 and meets with the frame panel 32 to provide a continuously smooth work surface 22.

Figure 5:
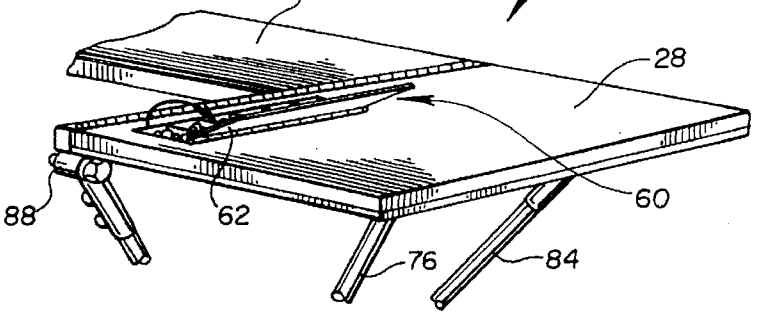
FIG. 5 is a fragmentary perspective view showing an alternative embodiment of the work surface for the portable work station in accordance with the present invention.

Referring to FIG. 5, another embodiment of work surface 22 is shown. Work surface 22 may include a tray 60, for holding a number of desired devices, such as tools, nuts, bolts, washers, etc. The tray 60 is easily accessible by opening hinged lid 62. When hinged lid 62 is in a closed position, the hinged lid 62 is useable as a part of work surface 22. It is recognized that various different size and shapes of trays may be located at desired location within the work surface 22, including first side panel member 26, second side panel member 28, insert panel 30, and/or frame panel 32.

Support structure 24 generally includes a cross support member 69 having a first support leg 70, a second support leg 72, and a U-shaped support member 73 having a third support leg 74 and a fourth support leg 76. Additionally, support structure 24 further includes left support bar 82 and right support bar 84. First support leg 70 and second support 72 are mechanically coupled to the front edge of frame 34 at a dual hinge mechanism which includes hinge system 86 and hinge system 88, respectively. Hinge system 86 and hinge system 88 will be described in detail later in this specification.

U-shaped member 73 provides support to work surface 22 along the rear edge of the work surface 22. U-shaped member 73 is rotatably coupled to first support leg 70 proximate the mid-point of first support leg 70 using bolt system 90. Similarly, U-shaped member 73 is rotatably coupled to third support leg 74 proximate the mid-point of fourth support leg 76 using bolt system 92.

Chain 94 is coupled between first support leg 70 and second support leg 72 limiting the range of relative angular movement between first support leg 70 and second support leg 72. Similarly, chain 96 is coupled between third support leg 74 and fourth support leg 76 limiting the range of relative angular movement between third support leg 74 and fourth support leg 76.

For lateral stability, cross brace 78 is rotatably coupled between first support leg 70 and second support leg 74 using a U-shaped coupling system 98, and cross brace 80 is rotatably coupled between first support leg 70 and third support leg 74 using U-shaped couplings 98. Cross brace 78 is rotatably coupled to cross brace 80 using a pin system 100 which extends through strap 102, cross brace 78 and cross brace 80.

Left support bar 82 is rotatably coupled between bolt system 90 and an outside edge of first side panel member 26, and right support bar 84 is rotatably coupled between bolt system 92 and the outside edge of second side panel member 28. Left support bar 82 and right support bar 84 provide structural support to the outside edges of first side panel member 26 and second side panel member 28, respectively.

Figure 7:
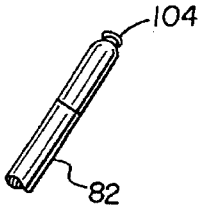
FIG. 7 is a fragmentary detailed perspective view of a support bar in accordance with the present invention.
Figure 8:
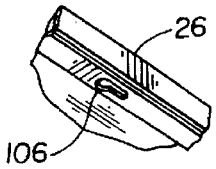
FIG. 8 is a fragmentary detailed perspective view of an insert hole for the support bar of FIG. 7.
Figure 6:
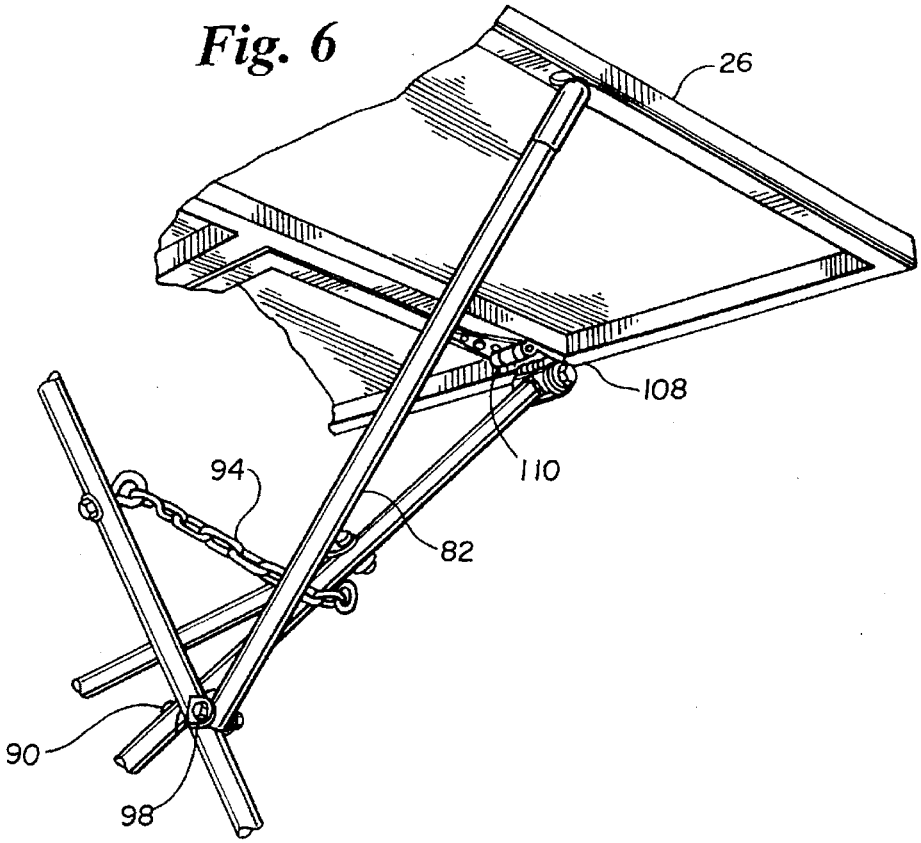
FIG. 6 is a fragmentary bottom perspective view of the right hand side of the portable work station shown in FIG. 1.

Referring to FIG. 6, a fragmentary rear perspective view of left support bar 82 is shown. Left support bar 82 is rotatably coupled at one end to first support leg 70 and second support leg 72 using U-shaped coupling 98 secured to bolt system 90. The other end of left support bar 82 is removably coupled to the underside of first side panel member 26. As shown in FIG. 7, support bar 82 includes a peg 104 secured to the end of the support bar 82. Referring to FIG. 8, first side panel member 26 includes a slot 106 for removable receipt of the peg 104 for attaching the support bar 82 to the underside of first side panel member 26.

Referring again to FIG. 6, hinge system 86 and hinge system 88 (shown in FIG. 1) are double hinge systems. A first hinge 106 allows the work surface 22 to be rotated upward relative to a longitudinal axis defined by the front edge of the work surface 22 (within a predetermined range), and a second hinge 110 allows work surface 22 to be rotated downward relative to a longitudinal axis with respect to the front edge of the work surface 22 (within a predetermined range) when in a folded or collapsed position.

The portable work station 20 is formed of a sturdy, light-weight construction, and easily collapses upon itself for compact storage while not in use. The portable work station 20 of the present invention provides a stable work surface for many general and speciality uses. Additionally, by simply removing insert panel 30, the user is able to work on projects positioned on the work surface 22 while positioned within the opening. For example, in one application the portable work station 20 is used for automobile bumper maintenance and repair in the automotive industry. The automobile bumper is supported by the work surface 22 first side panel member 26, frame panel 32, and second side panel member 28. An automotive technician can work on the automobile bumper while positioned within the opening, instead of working in an uncomfortable position which requires that the automotive technician lean over the table to reach portions of the automotive bumper. In use, the portable work station 20 easily supports up to 600 pounds. It is recognized that by forming the portable work station 20 out of other materials, the work surface 22 can support in excess of 600 pounds.

Figure 9:
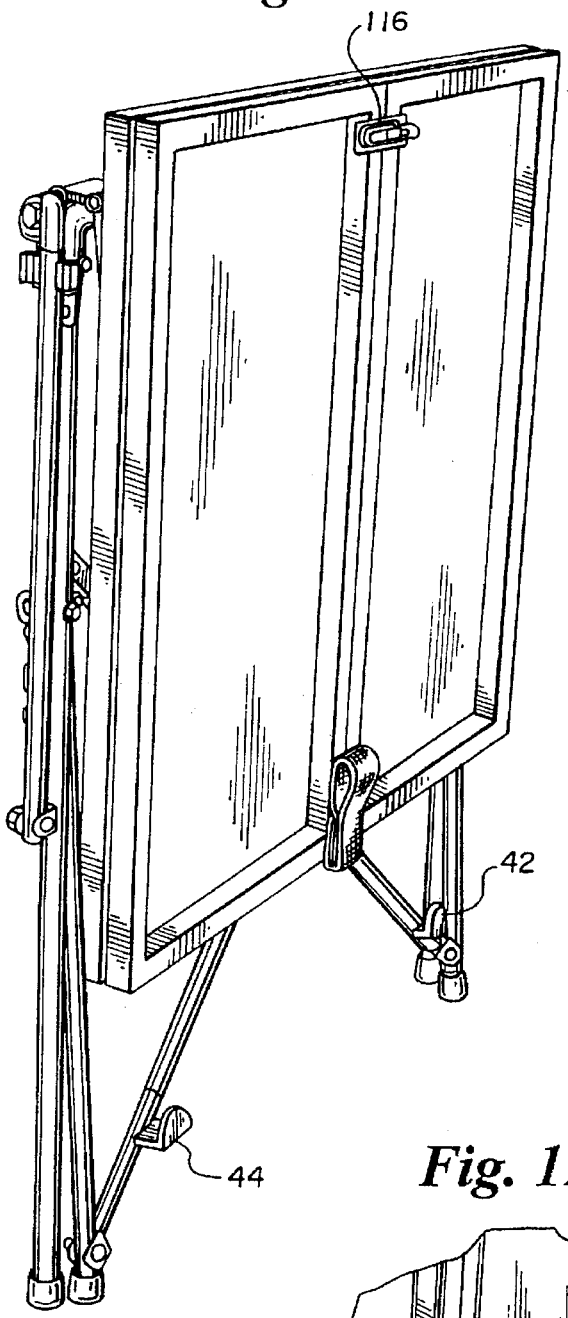
FIG. 9 is a front perspective view of the present invention shown in a folded position.

Referring to FIG. 9, the portable work station 20 easily folds up for compact storage. In folding, left support bar 82 peg 104 is removed from the slot 106. The left support 82 is then snap-fit within clasp 112 located on U-shaped member 73. This allows first side panel member 26 to be rotated upward about hinge 36 and laid on top of insert panel 30 and frame panel 32.

Similarly, peg 105 is removed from slot 107. Right support bar 84 is positioned within clasp 114 located on the fourth support leg 76 of U-shaped member 73. Second side panel member 28 is rotated upward about hinge 38 and laid upon the right side of insert panel 30 and frame panel 32. The underside of first side panel member 26 and second side panel member 28 are secured together by closing retaining buckle 116.

Figure 10:
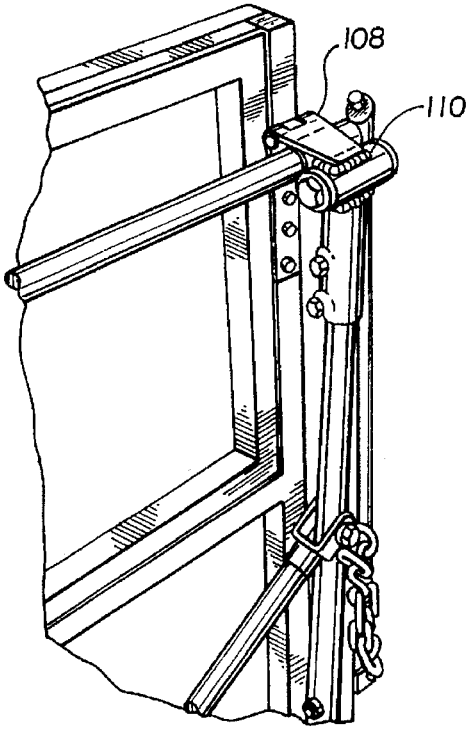
FIG. 10 is a rear fragmentary perspective view of the portable work station in accordance with the present invention shown in FIG. 9.

The rear edge of portable work station 20 is lifted off of U-shaped member 73 (using dual hinge system 86 and hinge system 88), allowing the top of U-shaped member 73 to be rotated about bolt system 90 and bolt system 92, and folded together against first support leg 70 and second support leg 72. Referring also to FIG. 10, the work surface 22 is now dropped down over the top of U-shaped member 73. The dual hinging of hinge system 86 and hinge system 88 allows the work surface 22 to rotate and hinge around the U-shaped member 73 such that the work surface 22 is folded in a compact position against the folded support structure 24.

Figure 11:
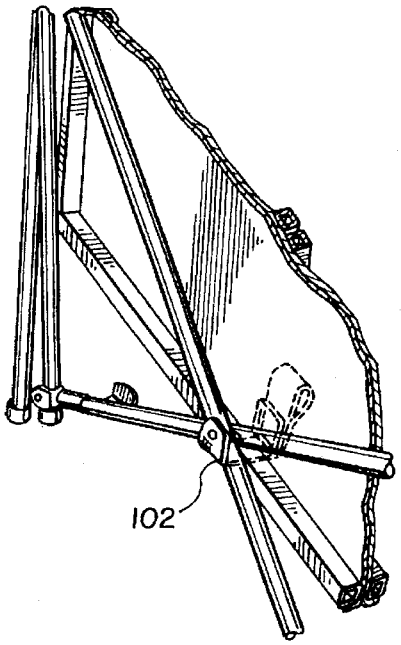
FIG. 11 is a rear fragmentary perspective view of the portable work station shown in FIG. 9.
Figure 12:
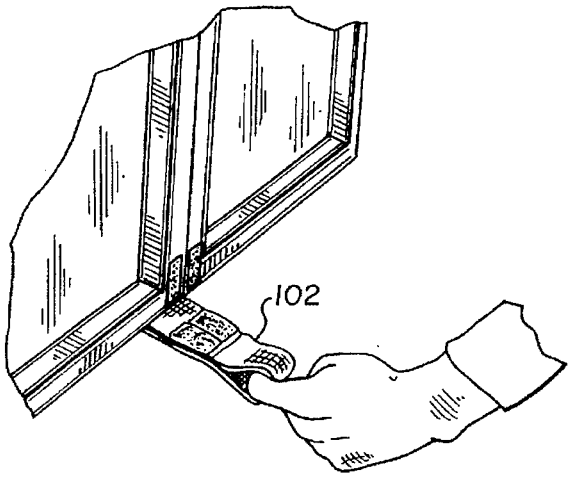
FIG. 12 is a front fragmentary perspective view of the portable work station shown in FIG. 9.

Referring to FIG. 11, folded portable work station 20 is releasably secured in a folded position by wrapping strap 102 underneath and around the support structure 24 cross braces and underneath the edge of the work surface 22. Referring to FIG. 12, strap 102 is pulled tight and retained against the underside of the work surface 22, and specifically, the first side panel member 26 and second side panel member 28 using VELCRO system 118. Folded portable work station 20 is now in a folded, compact position with a width of approximately 4 inches. For unfolding, the above recited procedure is simply reversed, and portable work station 20 is again ready for use.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. A portable work station comprising:

a work surface having a removable panel located only along a front edge thereof;

a collapsible support structure; and means for hingedly securing the work surface to the support structure, wherein when the removable panel is removed from the work surface, the work surface is generally U-shaped having an opening therethrough proximate the size of the removable panel.

2. The portable work station of claim 1, wherein the support structure further includes means for storing the removable panel.

3. The portable work station of claim 1, wherein the work surface includes:

a frame;

a first side panel member hingedly secured to a first side edge of the frame; and a second side panel member hingedly secured to a second side edge of the frame.

4. A portable work station comprising:

a work surface having a removable panel located along a front edge thereof, a frame, a first side panel member hingedly secured to a first side edge of the frame, and a second side panel member hingedly secured to a second side edge of the frame;

a collapsible support structure; and means for hingedly securing the work surface to the support structure;

further wherein the support structure includes a first support member releasably coupled to the first side panel member and a second support member releasably coupled to the second side panel member.

5. The portable work station of claim 1, wherein the support structure includes:

a first U shaped member having a first leg and a second leg;

a first support leg rotatably coupled to the first leg; and a second support leg rotatably coupled to the second leg.

6. The portable work station of claim 5, wherein the support structure further includes a cross brace coupling the first support leg to the second support leg.

7. The portable work station of claim 1, wherein the means for hingedly securing the support structure to the work surface includes a double hinge mechanism.

8. A portable work station comprising:

a work surface having a removable panel located along a front edge thereof;

a collapsible support structure; and means for hingedly securing the work surface to the support structure wherein the means for hingedly securing the support structure to the work surface includes a double hinge mechanism, and wherein the double hinge mechanism includes a set of double hinges located along an edge of the work surface and on each side of the removable panel, each double hinge including a first hinge for rotating the work surface in a first range of motion, and a second hinge spaced inward from the first hinge for rotating the work surface through a second range of motion.

9. The portable work station of claim 1, wherein the means for hingedly securing the support structure to the work surface includes a first hinge system coupled between a first support leg and the work surface, and a second hinge system coupled between a second support leg and the work surface.

10. The portable work station of claim 9, wherein the first hinge system and the second hinge system each includes a pair of hinges.

11. The portable work station of claim 1, wherein the work surface further includes a storage tray.

12. The portable work station of claim 11, wherein the storage tray further includes a lid hingedly secured to the work surface.

13. The portable work station of claim 12, wherein the storage tray lid is part of the work surface.

14. A method of collapsing a portable work station comprising the steps of:

providing a work surface having a removable panel;

providing a hinge mechanism for hingedly securing the work surface to a collapsible support structure, the hinge mechanism including a set of double hinges located along an edge of the work surface and on each side of the removable panel, each double hinge including a first hinge spaced apart from a second hinge;

rotating the work surface through a first range of motion about the first hinge;

collapsing the support structure; and rotating the work surface through a second range of motion about the second hinge.

15. The method of claim 14, further comprising the step of securing the work surface to the support structure.

16. A method of collapsing a portable work station comprising the steps of:

providing a work surface having a removable panel;

providing a hinge mechanism for hingedly securing the work surface to a collapsible support structure, the hinge mechanism including a set of double hinges, each double hinge including a first hinge spaced apart from a second hinge;

rotating the work surface through a first range of motion about the first hinge;

collapsing the support structure; and rotating the work surface through a second range of motion about the second hinge;

further comprising the step of storing the removable panel on the support structure.

17. The method of claim 14, further wherein the work surface includes:

a frame;

a first side panel member hingedly secured to a first side edge of the frame; and a second side panel member hingedly secured to a second side of the frame.

18. The method of claim 17, further comprising the steps of:

folding the first side panel member over a portion of the frame; and folding the second side panel member over a portion of the frame.

19. The method of claim 14 wherein the collapsing of the support structure further includes:

providing a U-shaped support member rotatably coupled to a first support leg and a second support leg, wherein the first support leg and the second support leg are coupled to the hinge mechanism; and rotating the first U-shaped member relative to the first support leg and the second support leg.

20. A portable work station comprising:

a work surface assembly having a removable panel;

a collapsible support structure;

means for hingedly securing the work surface assembly to the support structure; and wherein the means for hingedly securing the support structure to the work surface includes a double hinge mechanism;

wherein the double hinge mechanism includes a set of double hinges located along an edge of the work surface and on each side of the removable panel, each double hinge including a first hinge for rotating the work surface in a first range of motion, and a second hinge spaced inward from the first hinge for rotating the work surface through a second range of motion.

* * * * *